US005088417A

United States Patent [19]

Richmond et al.

[11] Patent Number: 5,088,417

[45] Date of Patent: Feb. 18, 1992

[54] LIGHT WEIGHT CENTER BEAM RAILROAD CARS WITH PINNED CONNECTIONS

[75] Inventors: Shaun Richmond, Orland Park, Ill.; Charles T. Carter, Gary, Ind.; James J. Schuller, Crete, Ill.

[73] Assignee: Thrall Car Manufacturing Company, Chicago Heights, Ill.

[21] Appl. No.: 568,518

[22] Filed: Aug. 16, 1990

[51] Int. Cl.[5] ..... B61D 3/08

[52] U.S. Cl. ..... 105/411; 105/407

[58] Field of Search ..... 105/396, 399, 404, 407, 105/411

[56] References Cited

U.S. PATENT DOCUMENTS

| | | | |
|---|---|---|---|
| 522,105 | 6/1894 | Canda | 105/408 |
| 591,187 | 10/1897 | Coffin | 105/408 |
| 592,932 | 11/1897 | Lawler | 105/408 |
| 704,965 | 7/1902 | Hodges et al. | 105/407 |
| 751,436 | 2/1904 | Stucki | 105/407 |
| 4,082,045 | 4/1978 | McNally et al. | 105/407 |
| 4,681,041 | 7/1987 | Harris et al. | 105/355 |
| 4,753,175 | 6/1988 | Harris et al. | 105/355 |
| 4,784,067 | 11/1988 | Harris et al. | 105/355 |
| 4,802,420 | 2/1989 | Butcher et al. | 105/407 |

*Primary Examiner*—Robert J. Oberleitner
*Assistant Examiner*—Mark T. Le
*Attorney, Agent, or Firm*—Neuman, Williams, Anderson & Olson

[57] ABSTRACT

Center beam railroad car having a top chord, a parallel center sill below the top chord, columns joining the top chord and center sill, and diagonal tension members connecting the upper joint between one column and the top chord to the lower joint between another column and the center sill. In one embodiment, the tension member is pivotally secured at each end to the respective upper and lower joints, preventing fatigue failure of the tension member where it is secured to the joints. In another embodiment, at least one end of the tension member is secured to a joint between one end of a column and the center sill or top chord only after the joints are defined by assembling and joining the top chord, center sill, and columns. This method allows the tension members to be installed and to function substantially without tension in the unloaded, unused car and to accept tension loads when the car is loaded and operated.

2 Claims, 2 Drawing Sheets

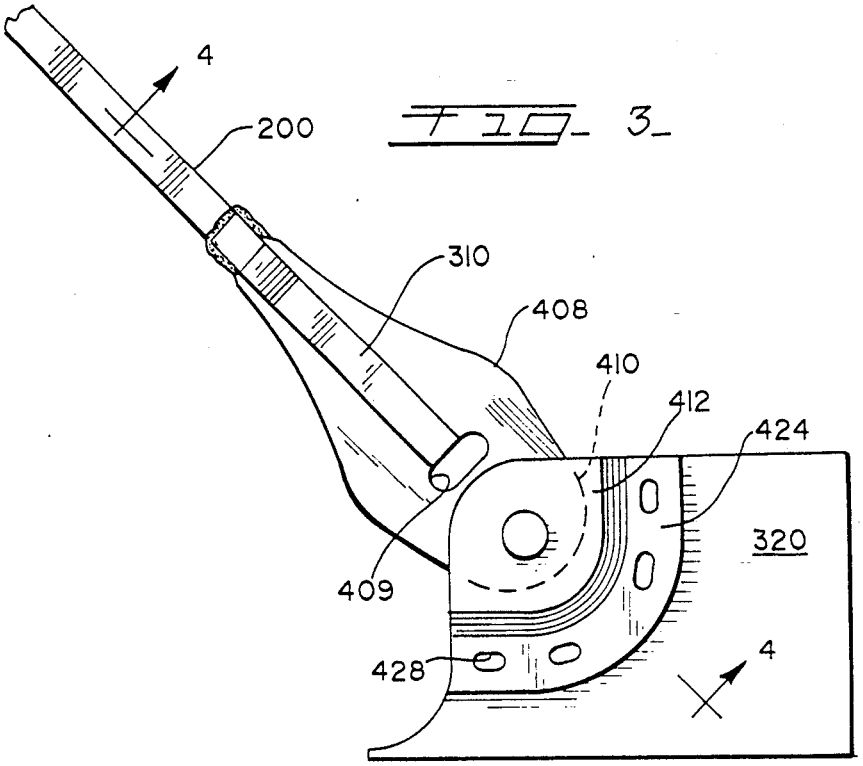
FIG. 3
FIG. 4
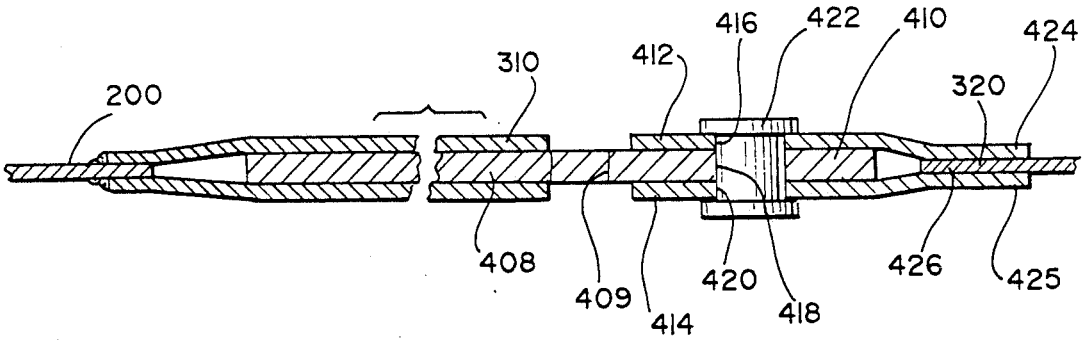

LIGHT WEIGHT CENTER BEAM RAILROAD CARS WITH PINNED CONNECTIONS

BACKGROUND OF THE INVENTION

This application is an improvement to the subject matter disclosed in U.S. Pat. No. 4,784,067, issued Nov. 15, 1988. FIGS. 1-10 and the portions of the text from column 1, line 7 to column 2, line 62; from column 3, line 7 to column 4, line 51; and from column 4, line 66 to column 5, line 18 of U.S. Pat. No. 4,784,067 are hereby incorporated herein by reference. The same subject matter is disclosed in U.S. Pat. Nos. 4,681,041 and 4,753,175, respectively issued July 21, 1987 and June 28, 1988.

FIGS. 5-8 and the accompanying text of the above patents describe a rigid welded connection between the ends 210, 310 of the bar braces or tension members 200, 300 and the upper and lower joint reinforcement plates 220, 320. The plates 220, 320 are joined at the intersections of the columns 68 and the top chord 26 or center sill 24. In the field, this rigid connection between the ends 210, 310 and the plates 220, 320 has been found to fatigue the tension members unduly. As a result, the tension members 200 tend to crack adjacent to the termination of the welds joining them to the plates 220, 320. The object of the present invention is to solve this cracking problem.

SUMMARY OF THE INVENTION

We have discovered that the cracking problem results in part from slight deviations of the bar braces from their proper positions with respect to the structural axes of the top chord and center sill.

Ideally, the structural axes of the top chord, a column, and the bar brace received at their joint all intersect at one point. The same should be true of the intersecting center sill, column, and bar brace.

In practice, when the cars are manufactured the tension member's structural axis is often displaced slightly, so it does not intersect the structural axes of the column and sills at a single point. Such deviations have been found to introduce bending moments into the tension members, thus flexing them repeatedly as the tensile loads on the tension members vary. An aggravating factor is that the tension members accept substantial tensile loads which vary from moment to moment as the loaded car negotiates curves, rocks, rolls, flexes, etc. during operation. These bending moments in the tension members, previously supposed to be trivial, have been found to be an important source of fatigue.

We have also discovered that this problem can be solved by pivotally connecting the ends of the respective tension members to the upper and lower joints at which the columns are received by the top chord and center sill of the car. The pivots have axes perpendicular to the plane of the columns. The tension members thus no longer accept bending moments in the plane of the columns. This change substantially improves the life and reduces the failure rate of the ends of the diagonal tension members.

We have also found a second contributor to the cracking problem. One or more of the tension members can be inadvertently permanently pretensioned when the car is assembled if the tension member is not precisely the right length in relation to the mating parts of the car. This tensile load is added to the tensile loads experienced when the car is loaded and operated, again accelerating the onset of fatigue.

We have found that this second problem can be solved in a car of the construction described herein by prescribing the order in which the parts of the car are assembled. This invention comprises the steps of first assembling and joining the center sill, top chord, and columns, then providing a sliding fit between a first part joined to the tension member (which might be an end of the tension member itself) and a second part joined to the corresponding joint (which might be one of the joined elements), then joining the first and second parts. This method effectively avoids substantially preloading the tension member when it is secured to the car.

BRIEF DESCRIPTION OF DRAWINGS

FIG. 3 is an enlarged detail view of the lower joint shown in FIG. 2.

FIG. 4 is a view taken along line 4–4 of FIG. 3.

DETAILED DESCRIPTION OF THE INVENTION

Figure 1:
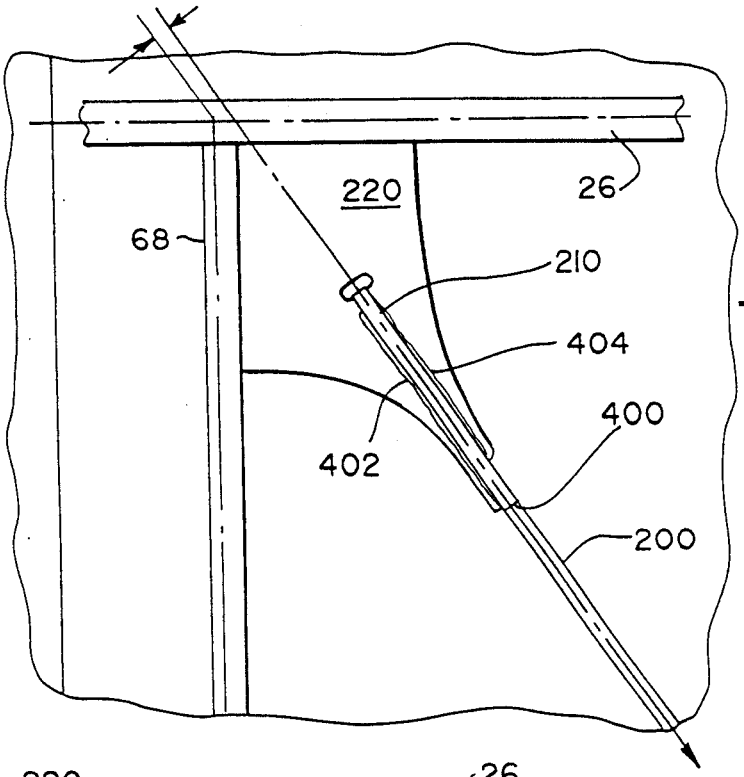
PRIOR ART FIG. 1
FIG. 1 is a diagrammatic partial side elevation of the top joint between the top chord, a column, and a tension member of a center beam car according to the prior art, illustrating deviation of the structural axis of the tension member from a line intersecting the structural axes of the top chord and column at a single point, and the resulting bending moments.

While the invention will be described in connection with certain preferred embodiments, it will be understood that we do not intend to limit the invention to those embodiments. On the contrary, we intend to protect all alternatives, modifications, and equivalents as may be included within the spirit and scope of the invention defined by the appended claims.

The layout and most of the details of the present car are described in the patent previously incorporated by reference. The reference characters used here are taken from the incorporated patent where appropriate.

Referring to FIG. 1, which shows prior art, the nature of the problem solved by the present invention is illustrated. The diagonal tension member 200 has a forked upper end 210 which receives and is welded to an upper joint reinforcement plate 220. The plate 220 is welded to and reinforces the intersection between the top chord 26 and the column 68. A common site of fatigue cracking 400 of the tension member 200 is at the inboard termination of the weld 402 joining the tension member 200 to the plate 220. The region surrounding the inboard termination of the weld 404 is less prone to cracking because this weld is shorter. Although only the upper joint of the tension member 200 is shown here, the lower joint has substantially the same construction (except that it is inverted) and is subject to the same fatigue cracking problem.

Figure 2:
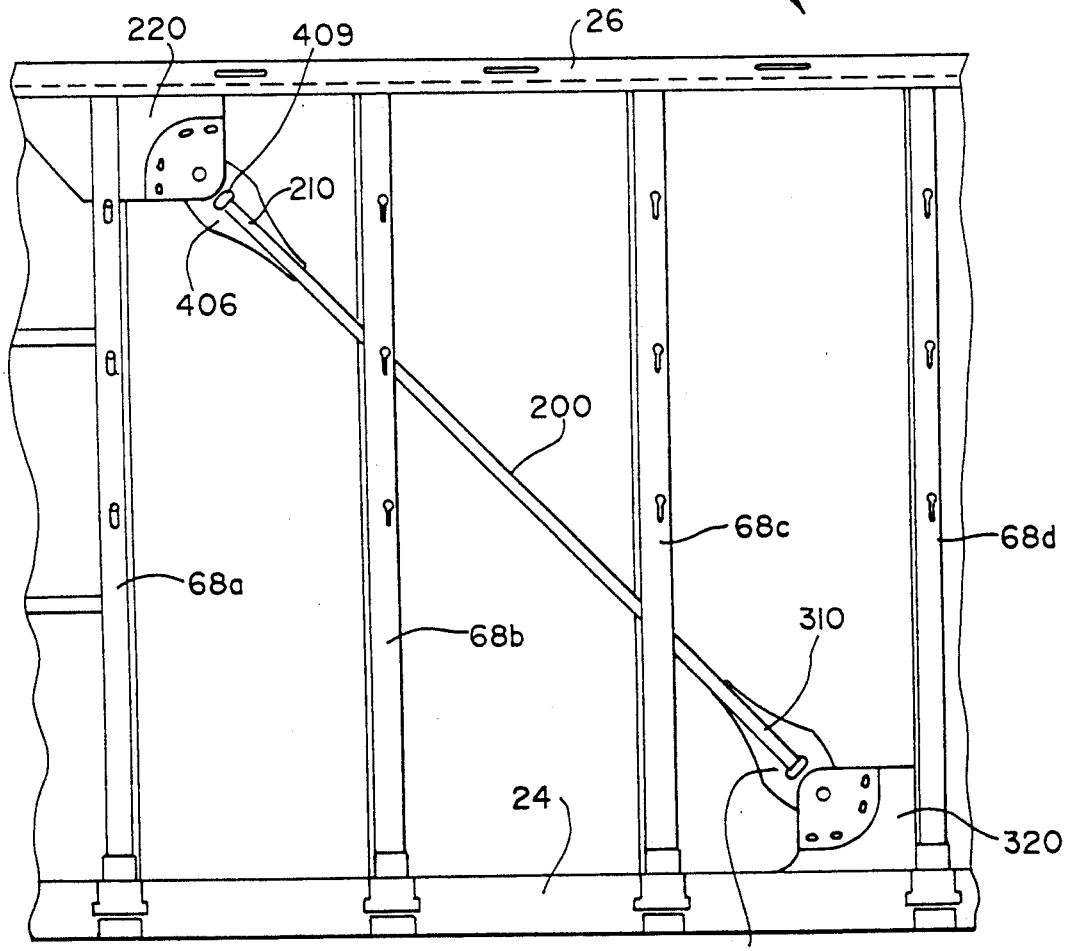
FIG. 2 is an enlarged fragmentary side elevation of the top chord, center sill, columns, and a diagonal brace of a center beam according to the present invention, showing pinned connections separating the upper and lower joint reinforcement plates from the ends of a diagonal tension member.

FIGS. 2 through 4 illustrate the present invention. The tension member 200 has forked upper and lower ends 210, 310 which receive and are welded to the upper and lower clevis plates 406, 408. The plates 406 and 408 are relieved by apertures such as 409.

The details of the lower joint are illustrated in FIGS. 3 and 4. The lower clevis plate 408 has an end 410 received in a slip fit between the bridge plates 412 and 414 (best shown in FIG. 4). The bridge plates 412 and 414 are congruent and registered in this embodiment. The registered apertures 416, 418, and 420 (respectively of the bridge plate 412, end 410, and bridge plate 414) receive a double-headed pin 422 to pivotally link the end 410 and the bridge plates 412 and 414.

The bridge plates 412, 414 have curved margins 424, 425 which overlap and are welded to opposite sides of the complementary margin 426 of the plate 320. The plate 320 here is thinner than the end 410, so the central portions of the plates 412 and 414 diverge to provide the slip fit previously described. The upper pivotal connection between the end 210 of the tension member 200 and the upper joint reinforcement plate 220 is the same as the lower pivotal connection just described, except that the upper connection is inverted.

The tension member 200 is connected to the upper and lower joints by pivots having axes perpendicular to the plane of the columns 68 *a–d*. As a result, no bending moment in the plane of the columns can be transmitted to the tension member 200 from the associated plates 220, 320. The fatigue problem identified previously is largely or wholly solved by this construction.

The manufacturing method according to the present invention is facilitated by the sliding fit of the bridge plates such as 412, 414 to the joint reinforcement plates 220 and 320 before the bridge plates and reinforcement plates are welded together. To build the car without pretensioning the tension members 200, notwithstanding variations in the length or position of these or associated members during manufacturing, the top chord 26, center sill 24, columns 68*a* through *d*, and joint reinforcement plates 220 and 320 are first assembled and joined as shown in FIG. 2, fixing the positions and relation of parts in the upper and lower joints of the center beam. Separately, the tension member 200, clevis plates 406 and 408, bridge plates such as 412 and 414, and pins such as 422 associated with the upper and lower ends 210 and 310 of the tension members are assembled and joined. Then, the margins such as 424 and 425 of the bridge plates such as 412 and 414 are slipped over the margins such as 426 of the joint reinforcement plates 220 and 320 of the upper and lower joints. A sliding fit is thus provided between the bridge plates and joint reinforcement plates. When the overlapped plates are aligned as illustrated, the margins such as 424 and 425 are welded to the respective sides of the margins such as 426 of the upper and lower joint reinforcing plates 220 and 320. Slots 428 are provided in the margins such as 424 and 425 to allow the plates to be extensively penetration welded together.

Because the tension member 200 is secured in place after the rest of the center beam load bearing structure is essentially complete, the tension member 200 is substantially untensioned in an unloaded car. Yet, the tension member 200 accepts tension readily as the car is loaded and operated.

The method described above can be modified slightly to make construction of the joint simpler The columns 68 *a–d*, top chord 26, center sill 24, upper joint reinforcement plate 220, pivotal connection, upper clevis 406, and end 210 of the tension member 200 can be completely assembled and joined as shown in FIG. 2. Separately, the lower clevis plate 408, bridge plates 412 and 414, and pin 422 of the lower joint can be preassembled as before. The only connections not yet made are the welds between the bridge plates 412 and 414 and the lower joint reinforcement plate 320. The tension member 200 is thus free to swing on its upper pivot, and the bridge plates are free to swing on the lower pivot with respect to the tension member. Then the bar 200 and bridge plates are pivoted to their final positions and the bridge plates 412, 414 are Welded to the lower joint reinforcement plate 320. Again, the tension member is effectively installed after the other load-bearing structure of the center beam is assembled, so the tension member is not under tension until the car is loaded and operated.

We claim:

1. A center beam for a railroad car comprising a center sill, a top chord parallel to and spaced above said center sill, at least first and second longitudinally spaced columns having upper ends secured to said top chord at upper joints and lower ends secured to said center sill at lower joints, and at least one diagonal tension member having an upper end secured by a first pivot at the upper joint of said first column and a lower end secured by a second pivot at the lower joint of said second column.

2. A method of making a center beam for a railroad car, sad center beam comprising a center sill, a top chord parallel to and spaced above said center sill, at least first and second longitudinally spaced columns having upper ends secured to said top chord at upper joints and lower ends secured to said center sill at lower joints, and a diagonal tension member having an upper end secured at the upper joint of said first column and a lower end secured at the lower joint of said second column, said method comprising the steps of:

A. assembling said center sill, top chord, and columns, thereby forming said upper and lower joints;

B. Providing pivots, for allowing pivotal movement, between first parts secured to said ends of said tension member and second parts secured to the corresponding joints.

* * * * *